US005216435A

United States Patent [19]

Hirata et al.

[11] Patent Number: 5,216,435

[45] Date of Patent: Jun. 1, 1993

[54] ARRAY ANTENNA POWER SUPPLY SYSTEM HAVING POWER SUPPLY LINES SECURED IN A CYLINDER BY ADHESIVE

[75] Inventors: Toshikiyo Hirata; Toshihide Niihara; Katsuhiko Yoshiki; Yujiro Taguchi; Tomoyuki Watanabe, all of Kanagawa, Japan

[73] Assignee: Toyo Communication Equipment Co., Ltd., Kanagawa, Japan

[21] Appl. No.: 499,341

[22] PCT Filed: Oct. 19, 1989

[86] PCT No.: PCT/JP89/01073

§ 371 Date: Jun. 18, 1990

§ 102(e) Date: Jun. 18, 1990

[87] PCT Pub. No.: WO90/04862

PCT Pub. Date: May 3, 1990

[30] Foreign Application Priority Data

Oct. 19, 1988 [JP] Japan ..... 63-263198
Jun. 26, 1989 [JP] Japan ..... 63-163497

[51] Int. Cl.[5] ..... H01P 5/00; H01Q 1/50

[52] U.S. Cl. ..... 343/853; 343/705; 333/1; 333/245

[58] Field of Search ..... 333/1, 24 R, 127, 136, 333/245, 260; 343/700 MS, 705, 850, 852, 853, 830

[56] References Cited

U.S. PATENT DOCUMENTS

| | | | |
|---|---|---|---|
| 2,611,869 | 9/1952 | Willoughby | 333/24 R X |
| 3,526,897 | 9/1970 | Cribb | 343/705 X |
| 4,318,107 | 3/1982 | Pierrot et al. | 343/700 MS |
| 4,709,240 | 11/1987 | Bordenave | 343/705 X |
| 4,766,444 | 8/1988 | Conroy et al. | 343/700 MS X |
| 5,019,829 | 5/1991 | Heckaman et al. | 343/705 X |

FOREIGN PATENT DOCUMENTS

| | | | |
|---|---|---|---|
| 165103 | 3/1986 | European Pat. Off. . | |
| 3632128.1 | 9/1986 | Fed. Rep. of Germany . | |
| 56-71303 | 6/1981 | Japan . | |
| 130903 | 7/1985 | Japan | 343/700 MS |
| 61-121011 | 7/1986 | Japan . | |
| 48103 | 3/1987 | Japan | 343/700 MS |
| 62-225003 | 10/1987 | Japan . | |
| 561241 | 9/1977 | U.S.S.R. | 333/127 |
| 2194101 | 2/1988 | United Kingdom . | |

OTHER PUBLICATIONS

"Conformal Microstrip Communication Antenna" by R. E. Munson, Oct. 1986, pp. 2331-2334 of vol. 2, MILCOM.

*Primary Examiner*—Robert J. Pascal
*Assistant Examiner*—Benny T. Lee
*Attorney, Agent, or Firm*—Graham & James

[57] ABSTRACT

A power supply system adapted for an array antenna to be mounted on satellites, airplanes, ships, land moving objects, or the like, which is so arranged that a cylindrical member (136) is provided at a peripheral edge part of an opening (135) formed on a wall member (134) on which the antenna is to be mounted, a group of power supply lines (143) connected to a group of power supply connectors (124) are disposed in an interior of the cylindrical member (136), and the space between the interior of the cylindrical member (136) and the group of power supply lines (143) is sealed by an adhesive (146), thereby securing the air-tightness and water-tightness.

2 Claims, 6 Drawing Sheets

ARRAY ANTENNA POWER SUPPLY SYSTEM HAVING POWER SUPPLY LINES SECURED IN A CYLINDER BY ADHESIVE

TECHNICAL FIELD

The present invention relates to an array antenna which is mounted on the outside surface of an airplane body and so on, and also to a power supply system for the antenna.

BACKGROUND ART

Heretofore, aircraft, whether military or civilian, have been equipped with various sorts of communication or radar array antennas.

In an array antenna of the type referred to, a plurality of antenna elements are mounted on a base in a side-by-side positional relationship and the antenna is usually mounted on the outside surface of an airplane body (wall body).

Further, an array antenna installed on the outside, for which a high environmental resistance performance is demanded, employs in many cases a structure wherein the aforementioned antenna elements are enclosed by a radome.

FIG. 8 exemplifies a microstrip array antenna as described, which comprises a metallic base 1, a grounding plate 2, a dielectric substrate 3, a radiation conductor 4 (antenna element), a coaxial cable 10 (power supply means) which is fixed in the metallic base 1 and the grounding plate 2 as passed therethrough to supply power from the cable via a central conductor 10*a* to the radiation conductor 4, these members being sequentially stacked on the metallic base 1 in this order.

Fixed on the metallic base 1 by means of rivets 8 at its peripheral edge is a radome 6 so that a metallic spacer 7 disposed between the radome and the radiation conductor 4 maintains a predetermined gap 5.

In the prior art array antenna, however, not only external parts including the metallic base 1, the radome 6 and so on but also internal constituent parts are all formed in a planar configuration. For this reason, in order for the prior art array antenna to be fixedly mounted on such a curved surface as the outside surface of an airplane, a spacer 12 must be provided between the bottom surface of the metallic base 1 and an airplane body 11 and as shown in FIG. 9.

Such provision of the spacer, however, causes an increase of a projection h of the array antenna from the airplane body at its both ends, which results in that the air resistance of the antenna is increased and thus this involves the vibration and deformation of the radome 6 due to the air pressure.

Since the radome 6 is usually made of such dielectric material as resin, a deformation in the radome 6 positioned in a beam radiation path causes a variation in the total dielectric constant of the radiation conductor 4 above it, which affects the beam characteristics of the antenna.

Further, the repetitive deformation of the radome 6 has a great effect on the mechanical strength of the radome 6 itself.

Meanwhile, this sort of array antenna to be externally installed includes a connector which passes through the airplane body to connect the respective antenna elements and a transmitter/receiver.

This is realized in the prior art, by positioning a flange part 24 of a connector 23 on an outer surface of an airplane body 25 and tightening the flange part 24 to the airplane body 25 through a packing 26 to thereby maintain the interior of the airplane body 25 in an air-tight condition, as shown in FIG. 10.

In the event where it is necessary to supply power individually to a multiplicity of antenna elements as in a phased array antenna, however, the above technique requires the formation of a multiplicity of holes in a relative small zone on the airplane body 25, thus making it difficult to secure the strength of this zone and the air tightness of the airplane body and further involving a large number of hole formation steps.

And this technique, when it is desired to make such holes in the body of an existing airplane being used, involves more difficulties in attaining that purpose.

In view of the above circumstances, it is an object of the present invention to provide an array antenna which can maintain the strength of a casing on which the antenna is to be installed and also maintain the air-tightness of the casing.

DISCLOSURE OF INVENTION

In accordance with one aspect of the present invention, the above object is attained by providing an array antenna wherein a plurality of antenna elements are arranged on a common base and the base and a radome for covering the plurality of antenna elements are both formed to be curved in accordance with the curved configuration of a wall body on which the antenna is to be mounted. Therefore, the total projection height of the antenna from the wall member can be minimized and made uniform.

In accordance with another aspect of the present invention, there is provided a power supply system which comprises an opening provided in a wall body on which an array antenna is to be mounted, a cylindrical member provided at a peripheral edge part of the opening, a group of power supply connectors disposed at a location of the array antenna corresponding to the opening of the wall body, a group of power supply lines disposed in an interior of the cylindrical member to be connected to the group of power supply connectors, and adhesive sealingly filled in the interior of the cylindrical member between the power supply lines to seal the cylindrical member.

With this power supply system, power supply can be realized in such a condition that the interior of a wall body on which the array antenna is mounted can be kept air-tight and water-tight.

BEST MODE FOR CARRYING OUT THE INVENTION

Figure 1:
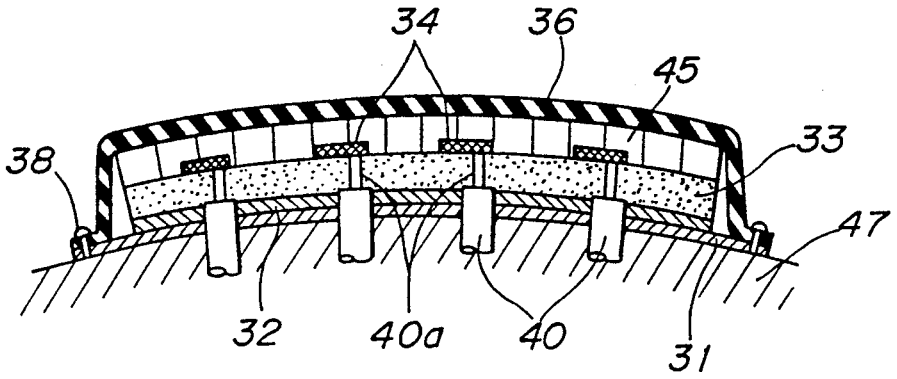
FIG. 1 is a front cross-sectional view showing an embodiment of a microstrip array antenna in accordance with the present invention.
Figure 2:
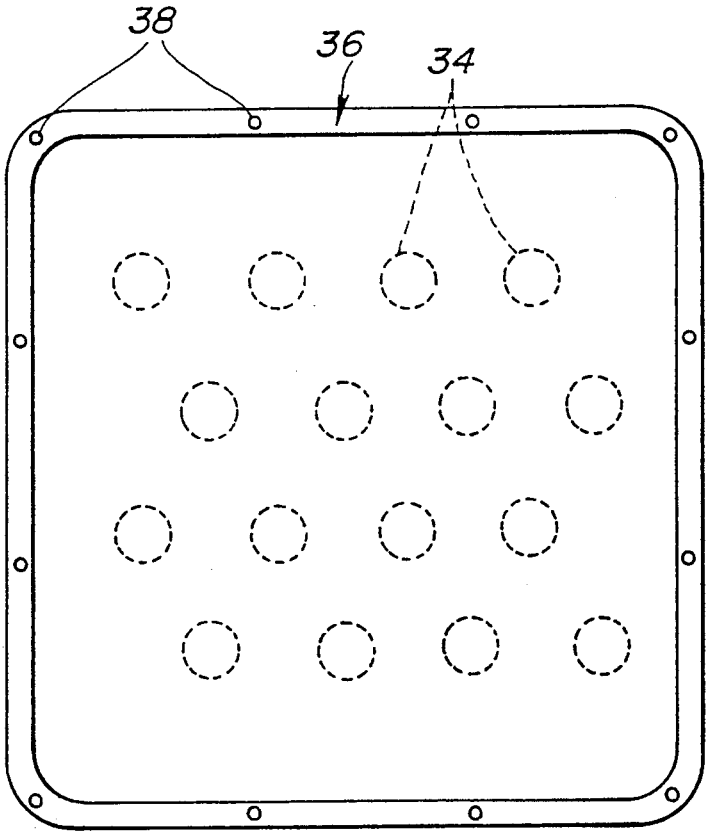
FIG. 2 is a plan view of the antenna of FIG. 1.

Referring to FIGS. 1 and 2, there is shown an embodiment of an array antenna in accordance with the present invention, respectively in a cross sectional view and in a plan view. The antenna of the present embodiment is of an array type in which a plurality of microstrip antenna elements are arranged and which functions, when the phase of these antenna elements is controlled, as a so-called sequencial array antenna.

As best seen in FIG. 1, the microstrip antenna comprises a base 31, a grounding plate 32, a dielectric substrate 33, a plurality of conductors 34 positioned as spaced at intervals of a predetermined distance on the dielectric substrate 33, coaxial cables 40 which are fixed as passed through the base 31 and the grounding plate 32 and central conductors 40*a* of which are connected to the respective radiation conductors 34, a paper honeycomb material 45 filled in a space defined between the dielectric substrate 33 and a radome 36, these members being sequentially stacked on the base 31 in this order.

The base 31, the grounding plate 32, the dielectric substrate 33 and the radome 36 are formed to be respectively curved so as to coincide with the curved configurations of an outside surface of an airplane body 47. For this reason, the bottom surface (base 31) of the antenna can be brought into a tight contact with the outside surface of the airplane body 47 and the curvature of the outside surface of the radome 36 can be made equal to that of the outside surface of the airplane body 47.

The respective radiation conductors 34 may be formed to be curved so as to coincide with the curvature of the airplane body 47 or may be formed to be planar.

The coaxial cables 40 corresponding in number to the radiation conductors 34 have been led out from the interior of the airplane body in the foregoing embodiment. However, when a distributor/compositer is provided for supplying power to the respective radiation conductors 34, it is suffice to use a single coaxial cable as a power supply line. A technique using such a distributor/compositer can be commonly applied even in other embodiments which will be explained in the following.

Mounting of the radome 36 can be carried out by covering the radome 36 on the paper honeycomb material 45 under such a condition that the paper honeycomb material 45 is placed on the dielectric substrate 33, and then by fixing the peripheral edge portion of the base 31 and radome 36 by means of rivets 38.

Since the paper honeycomb material 45 functions to support the radome 36 as contacted with the inner wall surface thereof, the supporting strength of the antenna can be improved to a large extent, the vibrational resistance can be improved, and further the influences exerted by wind pressure or pressure difference can be reduced to a large extent.

The honeycomb material 45, which is made of paper, has a dielectric constant of about 1 (corresponding to air). Thus, even when the honeycomb is disposed as tightly contacted with the radiation conductor 34, this will cause no disturbance of excitation mode of a beam radiated from the radiation conductors and therefore will cause no variation in the characteristics of the microstrip antenna. In addition, because of the honeycomb 45 made of paper, the antenna can be greatly reduced in weight so that the weight limitations imposed on prior art antennas for airplane mounting can be easily cleared, whereby the antenna of the present invention using the paper honeycomb can expand its structural design flexibility when compared with the prior art antenna using a metallic spacer.

Figure 3:
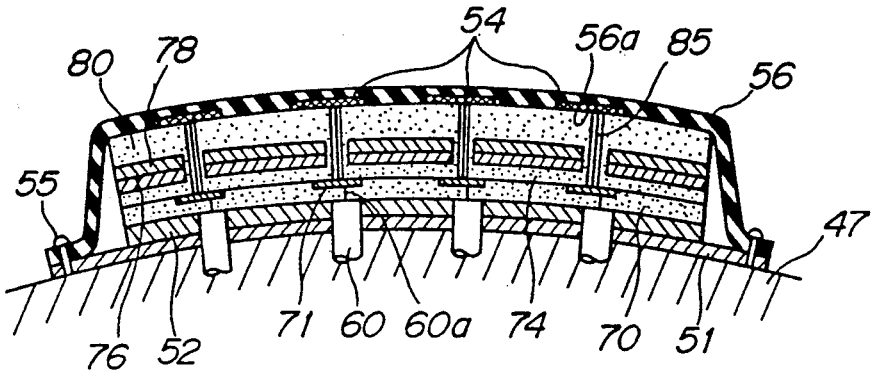
FIGS. 3 and 4 are cross-sectional views showing other embodiments of the array antenna of the present invention, respectively.

Shown in FIG. 3 is a microstrip array antenna in accordance with another embodiment of the present invention, which antenna includes a base 51 which forms the bottom plate of the antenna, a first grounding layer 52 made of dielectric material, a first dielectric substrate 70, LC matching circuits 71 of strip lines for impedance matching, a second dielectric substrate 74, a second grounding layer 76, a third grounding layer 78, a third dielectric substrate 80, a radome 56 disposed to cover these members, these members being sequentially stacked on the base 51 in this order.

The radome 56 is fixedly mounted on the base 51 by means of rivets 55. The radome 56 is provided in its inner bottom surface with a plurality of recessed 56*a* which are spaced from each other at intervals of a predetermined distance, and radiation conductors 54 are embedded in the respective recesses 56*a*.

The base 51 and the members sequentially stacked on the base 51 are formed to be curved so that theses members have the same curvature as the curved surface of a airplane body 47.

Coaxial cables 60 are fixed as passed through the base 51 and the first grounding layer 52 and have central conductors 60*a* connected to the associated LC matching circuits respectively. The LC matching circuits 71 are connected to the associated radiation conductors 54 by means of associated power supply pins 85.

The first and second grounding layers 52 and 76 enclose or sandwich the LC matching circuits 71 from upper and lower sides thereof and the third grounding layer 78 is disposed as opposed to the radiation conductors 54. The grounding layers 76 and 78 may be replaced by a single grounding layer which has the same functions as the layers 76 and 78.

The radiation conductors 54 have lower sides contacted with the upper side of the dielectric substrate 80 and also receive power from the respective power supply pins 85.

When the radome 56 is tightly contacted with the radiation conductors 54, this causes change of the excitation mode above the radiation conductors, whereby the antenna characteristics, in particular, the impedance characteristic is varied to a greater extent compared with the situation where the radome 56 is not used. In the present embodiment, such an impedance variation problem is solved by providing the matching circuits 71 in the input terminal portions to match the input impedance at a desired value. With such an arrangement, a variation in the input impedance characteristics caused by the close contact of the radome with the radiation conductors can be compensated for.

As has been explained above, in accordance with the embodiments shown in FIGS. 1 and 3, since the overall configuration of the array antenna including the radome is curved so as to coincide with the surface configuration of the airplane body 47 or the like, the total projection height of the antenna can be minimized.

Accordingly, it is possible to solve various problems in the prior art which have so far easily occurred when mounted on an airplane. More specifically, when the present invention is mounted on an airplane, since the air resistance can be reduced to a large extent, vibrations, expansions, shrinkages or other deformations in the radome caused by wind pressure can be prevented. As a result, the present invention can prevent the influences on the beam characteristics caused by deformations in the radome positioned in the beam radiation path, the influences on the mechanical strength and further the deterioration of an operating fuel cost.

Figure 4:
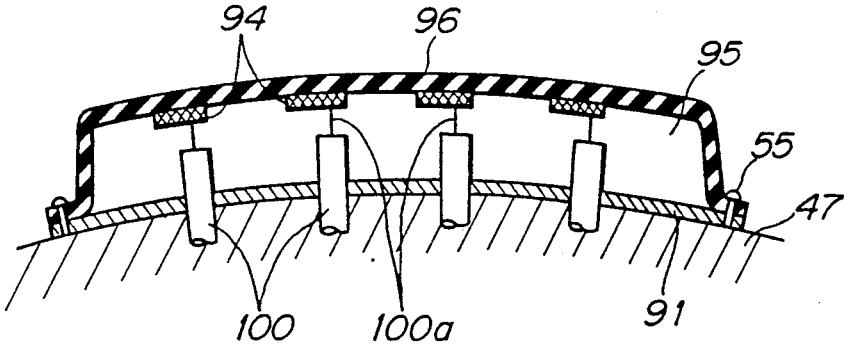

Referring to FIG. 4, there is shown a further embodiment of the microstrip array antenna in accordance with the present invention, which antenna includes a base 91 which is installed on the surface of a airplane body 47 and which is also used as a grounding plate, a radome 96 disposed on the base 91 to define a predetermined air gap 95 with the upper surface of the base 91, a plurality of radiation conductors 94 disposed on the inner side of the radome 96 with the lower sides of the conductors being exposed to the air gap 95, and a group of coaxial cables 100 fixed as passed through the base 91 and having central conductors 100*a* connected to the associated radiation conductors 94.

The base 91 is formed as curved so as to have the same curvature as the curved surface of the airplane body 47, and the upper side of the radome 96 is also formed as curved so as to have the same curvature as the curved surface of the airplane body 47.

The air trapped in the gap 95 defined by the base 91 and the radiation conductors 94 functions as a dielectric material.

Even the present embodiment, like the foregoing embodiments, can prevent the deformation of the radome due to wind pressure. The present embodiment is advantageous in that the number of necessary parts can be reduced to simplify the structure, the height of the radome can be set to be sufficiently small and further the weight can be made small.

Although any one of the antennas shown in the foregoing embodiments has been mounted on the surface of the airplane body 47, the antennas of the foregoing embodiments may be applied even to the curved wall or the like of a moving object or a building other than the airplane. To this end, objects on which the antenna is to be mounted are expressed inclusively as "wall body" in claims. claims.

Explanation will next be made as to an embodiment of a power supply system in accordance with the present invention.

Prior to the explanation of the embodiment, the general arrangement of an array antenna to which the present embodiment is applied, in particular, of an array antenna having a flat radiation surface for electromagnetic waves, will first be briefly explained.

Figure 6:
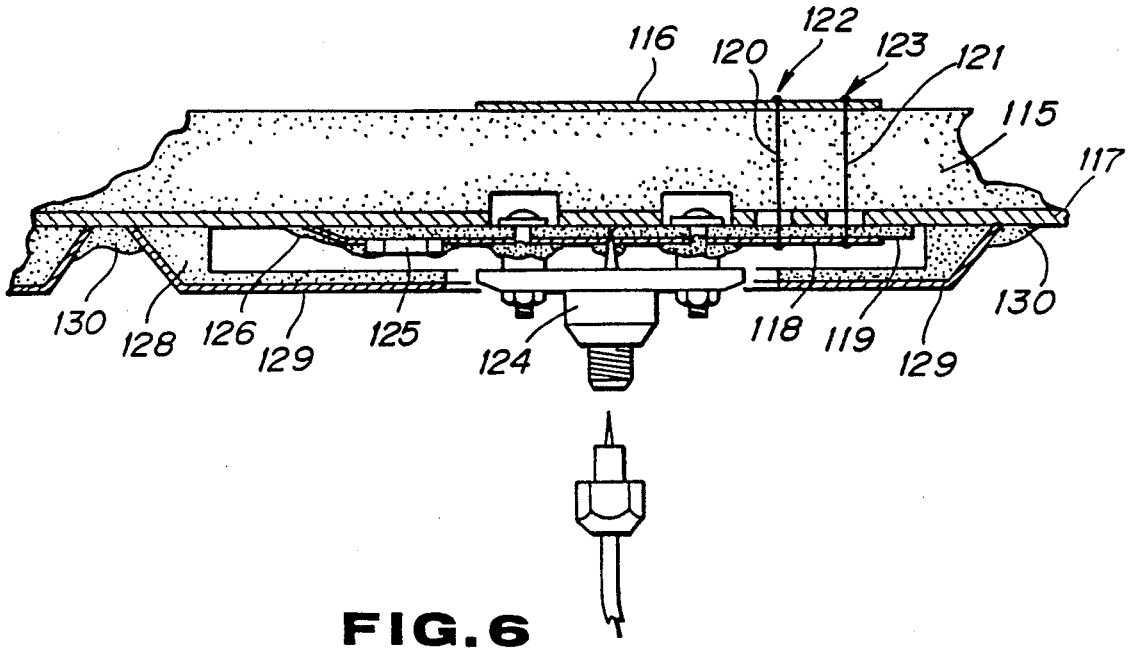
FIG. 6 is a cross-sectional view showing an example in which the same power supply system is applied to an array antenna.
Figure 7:
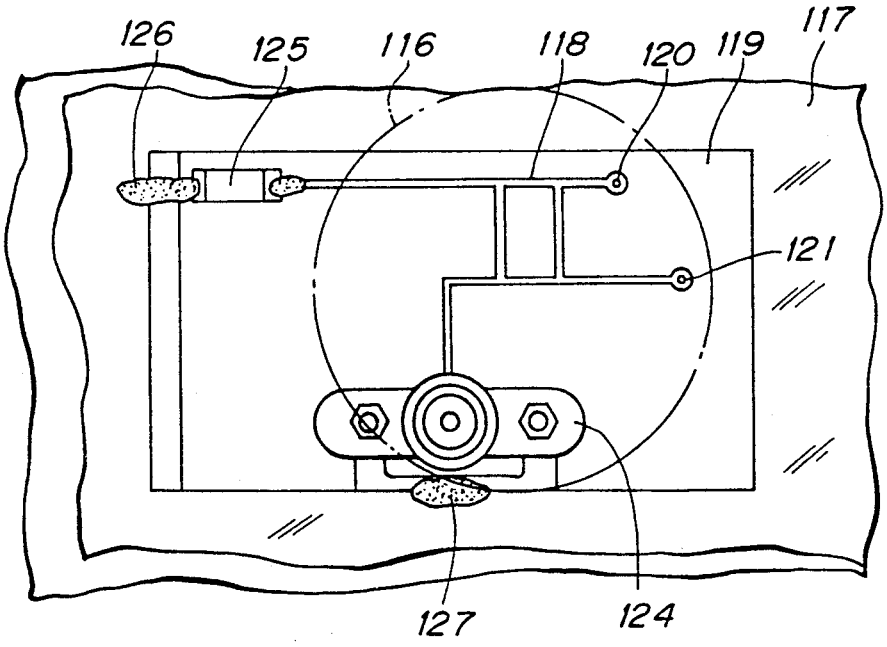
FIG. 7 is a fragmentary plan view of the antenna of FIG. 6.
Figure 8:
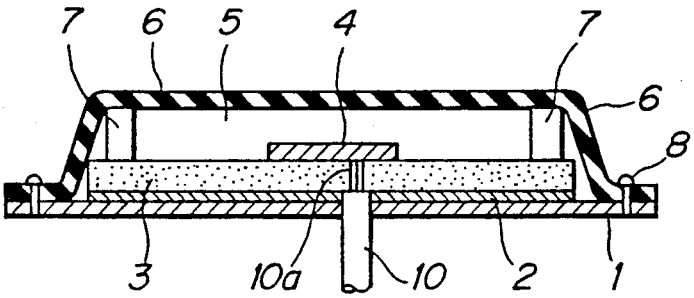
FIG. 8 PRIOR ART
FIG. 8 is a cross-sectional view showing a prior art array antenna.
Figure 9:
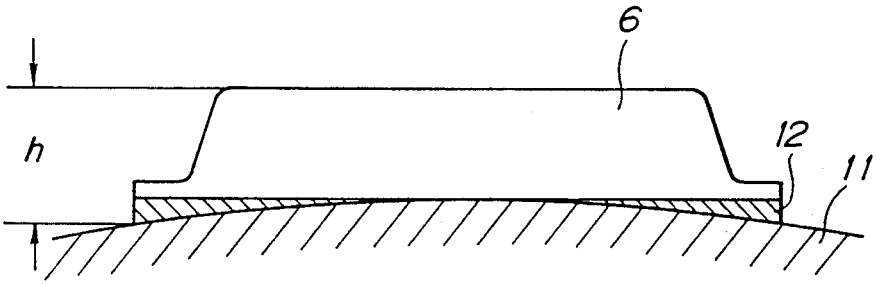
FIG. 9 PRIOR ART
FIG. 9 is a conceptional diagram showing a state in which the prior art array antenna is fixedly mounted on the body of an airplane.
Figure 10:
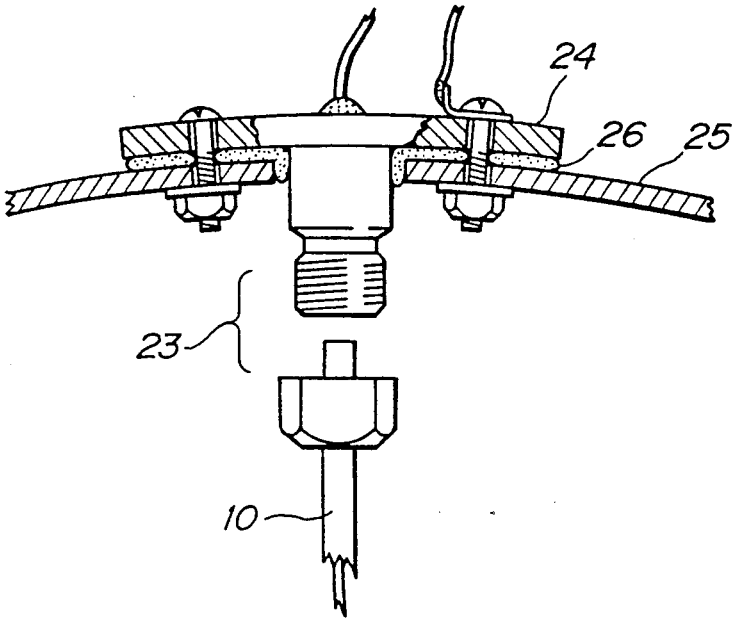
FIG.10 PRIOR ART
FIG. 10 is a fragmentary cross-sectional view showing a prior art power supply system.

FIGS. 6 and 7 are fragmentary cross-sectional and rear views of a microstrip phased array antenna of a rear two-point power supply type having flat radiation patches. Each one of antenna elements of the antenna includes a radiation patch 116 of, for example, a circular shape disposed on the front side of a dielectric material 115 (see FIG. 6) which forms a predetermined capacitance, a grounding plate 117 provided on the rear side of the dielectric material 115, a printed circuit board 119 bonded with adhesive on the rear side of the grounding plate 117 on which a hybrid circuit 118 is formed as shown in FIG. 7, and pins 120 and 121 passed through the dielectric material 115 and the printed circuit board 119 to connect the radiation patch 116 and the hybrid circuit 118.

With such an antenna element, power is supplied to the radiation patch 116 through the pins 120 and 121. In this case, when a phase difference between high frequency currents at power supply points 122 and 12 (see FIG. 7) is set to be a predetermined angle, and generally to be 90 degrees and further when the impedances at the power supply points 122 and 123 are matched at, for example, 50 ohms; the antenna element can radiate or receive circularly polarized electromagnetic waves. And when a multiplicity of such antenna elements are arranged and the phase of power supplied to the respective elements is sequentially rotated, a phased array antenna can be configured.

The hybrid circuit 118 is connected at its one end with a connector 124 fixedly mounted on the printed circuit board 119 and power supply to the antenna element is carried out through the connector 124.

The other end of the circuit 118 is soldered to the grounding plate 117 at a point 126 through a proper resistor 125.

The grounding side of the connector 124 is also soldered to the grounding plate 117 at a point 127 (see FIG. 7).

Further, the grounding plate 117 must be electrically connected to, e.g., the surface of an airplane body. However, the hybrid circuit 118 is provided on the rear side of the grounding plate 117 and may cause a short-circuiting. In FIG. 6 for the purpose of avoiding such a short-circuiting, a suitable insulating plate 128 is provided to abut at its peripheral part against the grounding plate 117 and the grounding plate 117 is grounded to the airplane body through an electrically conductive sheet 129 attached onto the rear side of the insulating plate 128. In this connection, interconnection between the grounding plate and the conductive sheet 129 is effected by joining with solder the grounding plate 117 to the protective insulating plate 128 at a suitable point 130 in its end part or opening.

The array antenna comprising a multiplicity of such antenna elements arranged as mentioned above can be made basically in the form of a highly thin plate and thus can avoid the increase of the aerodynamic resistance, whereby the antenna can be suitably used as an antenna in a communication system designed for mounting on an airplane.

Figure 5:
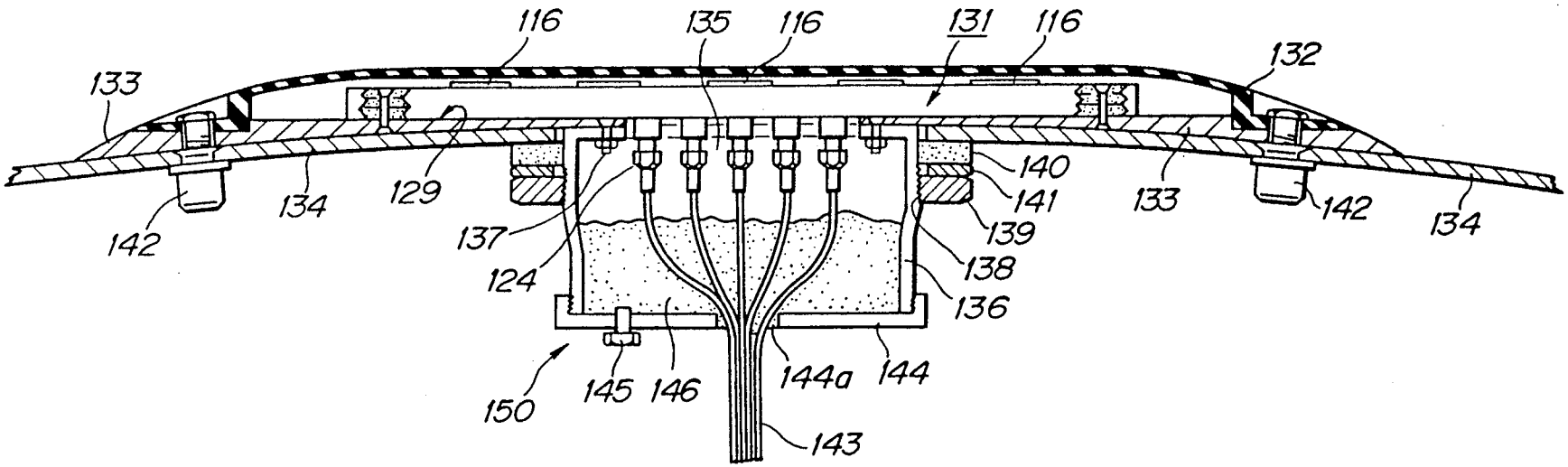
FIG. 5 is a cross-sectional view showing an embodiment of a power supply system in accordance with the present invention.

FIG. 5 shows an embodiment of the power supply system 150 in accordance with the present invention, which is applied to the aforementioned array antenna mounted on the pressurized bulkhead, airplane body or the like of an airplane.

In the drawing, a multiplicity of radiation patches 116 are arranged on a board 131 in a planar form, and the board 131 abuts against a pressurized bulkhead 134 in such a condition that the board 131 is sandwiched in between a radome 132 and a shim 133 made of aluminum alloy.

The shim is formed to be tightly contacted with a grounding conductive sheet 129 provided on the board 131 and to be fitted to the curved outside surface of the pressurized bulkhead 134.

Meanwhile, the pressurized bulkhead 134 is provided therein with an opening 135 which can accommodate therein a group of connectors 124 projected from the board 131 so as to avoid the grounding conductive sheet 129 attached onto the rear side of the board 131. A cylindrical member 135 is fixed by screws 137 to the shim 133 at the peripheral part of an opening made in the shim 133 which is slightly smaller in inner diameter than the opening 135 and which abuts against the opening 135 as substantially concentric therewith, so that the cylindrical member 136 passes through the opening 135 of the bulkhead 134 and depends from the board 131 into the interior of the bulkhead 134.

The cylindrical member 136 is provided at its outer circumferencial part with a threaded part 138 which is in threaded engagement with a nut 139. Since a packing 140 and a spring washer 141 are provided between the nut 139 and the bulkhead 134, the air tightness of the opening 135 in the bulkhead can be secured and the mechanical fixation of the cylinder 136 can be attained by tightening the nut 139.

The shim 133 is fixedly secured at its outer peripheral edge to the pressurized bulkhead 134 by tightly screwing bolts into the associated internal female threaded holes of air-tight pins 142 fixedly attached to the bulkhead 134.

The connectors 124 are connected with associated power supply coaxial cables (power supply lines) 143, 143, . . . respectively. The cables 143 are previously passed through an opening 144*a* provided in a lid 144 of the cylindrical member 136. And the connectors 124 are fixed to the board 131 and thereafter the open end of the cylinder 136 is fixedly covered with the lid 144.

After fixation of the lid 144, epoxy or silicon series adhesive 146 is filled into the interior of the cylindrical member 136 from an inlet port 145 provided in the lid 144 and then solidified or set therein.

With such a structure, even if the antenna radome 132 is destroyed through the collision of birds or the like against the radome and the air tightness of the opening 135 in the pressurized bulkhead 134 is destroyed, this will not affect the interior of the pressurized cabin of the airplane.

The afore-mentioned power supply system has been applied to the microstrip array antenna of the type wherein power is supplied from the rear side of the antenna element to the radiation patch at the two points in the foregoing example, but the power supply system may also be supplied to an antenna wherein power supply to a radiation patch is effected at one point and to an antenna wherein a power supply point or points are provided at the edge of a radiation patch.

Further, the power supply connectors 124 to the radiation patch have been provided concentrately at one location in the embodiment of FIG. 5. However, in the case where the number of such radiation patches is large, the power supply connectors may be divided into two or more groups and the connector groups may be separately concentratedly located. Even in such a case, the power supply system of the present invention can be effectively employed, as a matter of course.

Furthermore, the power supply system of the present invention is not restricted as its applications only to the planar antenna but may be applied to any sort of antenna so long as it is an array antenna wherein array antenna elements are arranged.

In addition, the application objectives of the power supply system of the present invention are not limited only to airplanes but also may include space navigation vehicles, warships, vessels, land moving objects, which require air-tightness or water-tightness in the space inside the outboard thereof.

INDUSTRIAL APPLICABILITY

An array antenna in accordance with the present invention is highly effective as an antenna to be mounted on an airplane which requires the mounted antenna to be low in its mounted height.

Further, since a power supply system in accordance with the present invention can supply power to an array antenna while keeping its air tightness and water tightness, the system can be effectively applied to an array antenna to be mounted, in particular, on the pressurized bulkhead or the like of an airplane.

We claim:

1. A power supply system for an array antenna including a plurality of antenna of antenna elements, a wall body having an outer surface and defining a wall opening over which said array antenna is mounted, comprising:

a shim having a surface fitted over the outer surface of the wall body, the shim surface disposed in contact with the outer surface of said wall body, said shim defining a shim opening at a position corresponding to said wall opening;

a board member on which said plurality of antenna elements are disposed, said board member being disposed on said shim;

a hollow cylindrical member provided at a peripheral edge part of said shim opening and extending through the wall opening of said wall body;

a plurality of power supply connectors disposed on the board member at the shim opening, each of said power supply connectors being connected to a corresponding one of the antenna elements;

a plurality of power supply lines disposed in an interior of said cylindrical member, each power supplied line being connected to a corresponding one of said power supply connectors; and adhesive material disposed in the interior of said cylindrical member around said power supply lines to an inner wall of said cylindrical member for preventing air from passing through the cylindrical member.

2. A power supply system as set forth in claim (1), wherein said power supply connectors are housed in the interior of said cylindrical member.

* * * * *

UNITED STATES PATENT AND TRADEMARK OFFICE

CERTIFICATE OF CORRECTION

PATENT NO. : 5,216,435

DATED : June 1, 1993

INVENTOR(S) : Hirata, et al

It is certified that error appears in the above-indentified patent and that said Letters Patent is hereby corrected as shown below:

Column 8, line 28, claim 1, delete the first occurrence of "of antenna".

Signed and Sealed this

Twelfth Day of April, 1994

Bruce Lehman

*Attest:*

BRUCE LEHMAN

*Commissioner of Patents and Trademarks*

*Attesting Officer*